US007879165B2

(12) United States Patent
Mori et al.

(10) Patent No.: US 7,879,165 B2
(45) Date of Patent: Feb. 1, 2011

(54) METHOD FOR PRODUCING MAGNESIUM ALLOY PLATE AND MAGNESIUM ALLOY PLATE

(75) Inventors: Nobuyuki Mori, Itami (JP); Nozomu Kawabe, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 685 days.

(21) Appl. No.: 11/597,793

(22) PCT Filed: Mar. 24, 2006

(86) PCT No.: PCT/JP2006/305928

§ 371 (c)(1),
(2), (4) Date: Nov. 28, 2006

(87) PCT Pub. No.: WO2006/104028

PCT Pub. Date: Oct. 5, 2006

(65) Prior Publication Data

US 2008/0279715 A1 Nov. 13, 2008

(30) Foreign Application Priority Data

| | | | |
|---|---|---|---|
| Mar. 28, 2005 | (JP) | ..... | 2005-092247 |
| Sep. 9, 2005 | (JP) | ..... | 2005-263093 |
| Feb. 16, 2006 | (JP) | ..... | 2006-040013 |

(51) Int. Cl.

| | |
|---|---|
| ***C22F 1/06*** | (2006.01) |
| ***C22C 23/00*** | (2006.01) |
| ***B21B 23/00*** | (2006.01) |
| *C22C 23/02* | (2006.01) |
| *C22C 23/04* | (2006.01) |

(52) U.S. Cl. ..... 148/667; 148/420; 420/402; 420/407; 420/408; 420/411; 72/365.2

(58) Field of Classification Search ..... 420/402, 420/407, 408, 411; 148/424, 667, 420; 72/365, 72/365.2

See application file for complete search history.

(56) References Cited

FOREIGN PATENT DOCUMENTS

| | | |
|---|---|---|
| CN | 1596159 | 3/2005 |
| EP | 1 510 265 | 6/2003 |
| JP | 06-081089 | 3/1994 |
| JP | 2001-200349 | 7/2001 |
| JP | 2001-294966 | 10/2001 |
| JP | 2003-27173 | 1/2003 |
| JP | 2003-268477 | 9/2003 |
| JP | 2003-311360 | 11/2003 |
| JP | 2004-17114 | 1/2004 |
| JP | 2004-060048 | 2/2004 |
| JP | 2004-124152 | 4/2004 |
| JP | 2004-181501 | 7/2004 |
| JP | 2004-346351 | 12/2004 |
| JP | 2004-351486 | 12/2004 |
| JP | 2004-353043 | 12/2004 |
| JP | 2005-002378 | 1/2005 |
| JP | 2005-29871 | 2/2005 |
| JP | 2006-16656 | 1/2006 |
| JP | 2006-144043 | 6/2006 |
| JP | 2006-144044 | 6/2006 |
| JP | 2006-144059 | 6/2006 |
| JP | 2006-144062 | 6/2006 |
| WO | WO 03/103868 A1 | 12/2003 |
| WO | WO 2004/076097 A1 | 9/2004 |

OTHER PUBLICATIONS

Liang et al., The Twin-Roll Strip Casting of Magnesium, May 2004, JOM, vol. 56, No. 5, p. 26-28.*
Chinese Office Action, with English Translation, issued in Chinese Patent Application No. CN 200680000313.0, issued on Apr. 4, 2008.
International Search Report for PCT/JP2006/305928.
Japanese Notification of Reasons for Rejection, w/ English translation thereof, issued in Japanese Patent Application No. JP 2006-040013 dated Jan. 15, 2010.

* cited by examiner

*Primary Examiner*—Roy King
*Assistant Examiner*—Caitlin Fogarty
(74) *Attorney, Agent, or Firm*—McDermott Will & Emery LLP

(57) ABSTRACT

The present invention provides a method for producing a magnesium alloy sheet capable of producing a magnesium alloy sheet having excellent plastic workability such as press workability. The method of the present invention includes rolling a magnesium alloy blank with a reduction roll. The rolling includes controlled rolling performed under the following conditions (1) and (2) wherein M (% by mass) is the Al content in a magnesium alloy constituting the blank:

(1) the surface temperature Tb (° C.) of the magnesium alloy blank immediately before insertion into the reduction roll satisfies the following expression:

$$8.33\times M+135 \leqq Tb \leqq 8.33\times M+165$$

wherein $1.0 \leqq M \leqq 10.0$; and (2) the surface temperature Tr of the reduction roll is 150° C. to 180° C.

9 Claims, No Drawings

METHOD FOR PRODUCING MAGNESIUM ALLOY PLATE AND MAGNESIUM ALLOY PLATE

RELATED APPLICATIONS

This application is the U.S. National Phase under 35 U.S.C. §371 of International Application No. PCT/JP2006/305928 filed on Mar. 24, 2006, which in turn claims the benefit of JP 2005/092247 filed on Mar. 28, 2005; JP 2005/263093 filed on Sep. 9, 2005; and JP 2006/040013 filed on Feb. 16, 2006.

TECHNICAL FIELD

The present invention relates to a method for producing a magnesium alloy sheet and a magnesium alloy sheet produced by the method. In particular, the present invention relates to a method for producing a magnesium alloy sheet capable of producing a magnesium alloy sheet with excellent press workability.

BACKGROUND ART

Magnesium alloys are low-density metals and have high strength and high rigidity and are thus attract attention as lightweight structural materials. In particular, expanded materials are excellent in mechanical properties such as strength and toughness, and thus expected to be popularized in future. The properties of magnesium alloys are changed by changing the types and amounts of the metal elements added. In particular, alloys (for example, AZ91 on the basis of the ASTM standards) having high aluminum contents have high corrosion resistance and high strength and are in great demand as expanded materials. However, magnesium alloys have low plastic workability at room temperature because of the hexagonal close-packed crystal structure thereof, and thus press working of sheet materials are carried out at a high sheet temperature of 200° C. to 300° C. Therefore, the development of magnesium alloy sheets capable of stable working at as low a temperature as possible has been desired.

In producing a magnesium alloy sheet, various methods can be used. However, for example, die casting and thixomolding have difficulty in producing a thin alloy sheet and have the problem of producing many crystals in a magnesium alloy sheet produced by rolling an extruded material of a billet, increasing the crystal grain size, or roughening the surface of the sheet. In particular, in a magnesium alloy with a high Al content, crystals or segregation easily occurs in casting, and there is thus the problem of leaving crystals or segregated substances in the final alloy sheet even after a heat treatment step and a rolling step after casing, thereby causing a starting point of breakage during press working.

In a typical example of conventional known methods for producing a magnesium alloy sheet, a magnesium alloy blank is pre-heated to 300° C. or more and then rolled with a reduction roll at room temperature, the pre-heating and rolling being repeated.

Also, as a technique for producing a magnesium alloy sheet containing fine crystal grains for improving plastic workability, the method disclosed in Patent Document 1 is known. This method includes rolling a magnesium alloy blank at a surface temperature of 250° C. to 350° C. with a reduction roll at a surface temperature of 80° C. to 230° C.

Other known techniques for improving the plastic workability of magnesium alloy sheets are disclosed in Patent Documents 2 to 5.

Patent Document 1: Japanese Unexamined Patent Application Publication No. 2005-2378

Patent Document 2: Japanese Unexamined Patent Application Publication No. 2003-27173

Patent Document 3: Japanese Unexamined Patent Application Publication No. 2005-29871

Patent Document 4: Japanese Unexamined Patent Application Publication No. 2001-294966

Patent Document 5: Japanese Unexamined Patent Application Publication No. 2004-346351

DISCLOSURE OF INVENTION

Problems to be Solved by the Invention

However, the method of repeating pre-heating of a blank at 300° C. or more and rolling with a reduction roll at room temperature coarsens the crystal grains of a magnesium alloy in pre-heating and thus degrades the plastic workability of the resultant magnesium alloy sheet.

On the other hand, in the method of Patent Document 1, rolling is performed for a magnesium alloy sheet at a surface temperature of 250° C. to 350° C., and a plurality of rolling passes under this conditions removes the working strain produced in the alloy sheet in the last rolling pass. Therefore, working strain is not accumulated in the sheet with a final thickness, and the crystal grains of the magnesium alloy sheet are not sufficiently made fine in some cases. As a result, the plastic workability of the resultant magnesium alloy sheet cannot be sufficiently improved.

Patent Document 2 discloses a method for producing a magnesium alloy thin sheet containing AZ91. However, the document does not specify a specific characteristic value of mechanical strength and press formability of the magnesium alloy thin sheet.

Patent Document 3 discloses an AZ91 alloy sheet material. Patent Document 3 also discloses an example of a tensile test in which superplasticity was expressed under conditions including 300° C. and a strain rate of 0.01 ($s^{-1}$), and an elongation of 200% was recorded. However, the document does not specify plastic workability and tensile properties at the temperature (250° C. or less) of actual press forming of the sheet material, and also does not describe an example of press forming.

Patent Documents 4 and 5 also do not disclose specific values of tensile properties.

Furthermore, the above-descried cited references 1 to 5 do not disclose that the amounts of crystals and segregation produced in a magnesium alloy during casing are decreased to improve plastic workability, particularly press workability.

Accordingly, an object of the present invention is to provide a method for producing a magnesium alloy sheet capable of producing a magnesium alloy sheet having excellent plastic workability such as press workability.

Another object of the present invention is to provide a magnesium alloy sheet having excellent plastic workability such as press workability.

A further object of the present invention is to provide a magnesium alloy sheet having high strength and elongation and excellent press workability using a twin-roll cast raw material.

Means for Solving the Problems

A method for producing a magnesium alloy sheet of the present invention includes rolling a magnesium alloy blank with a reduction roll. The rolling includes controlled rolling performed under the following conditions (1) and (2) wherein M (% by mass) is the Al content in a magnesium alloy constituting the blank.

(1) The surface temperature Tb (° C.) of the magnesium alloy blank immediately before insertion into the reduction roll satisfies the following equation:

$$8.33\times M+135\leqq Tb\leqq 8.33\times M+165$$

wherein $1.0\leqq M\leqq 10.0$.

(2) The surface temperature Tr of the reduction roll is 150° C. to 180° C.

When the reduction roll temperature Tr and the surface temperature Tb of the blank were specified as described above, rolling can be performed within a range causing no recrystalliztaion of the crystal gains of the magnesium alloy. Consequently, coarsening of the crystal grains of the alloy can be suppressed, and rolling can be performed while preventing the occurrence of cracks in the surface of the blank.

A magnesium alloy sheet of the present invention is produced by the method for producing the magnesium alloy sheet of the present invention.

The magnesium alloy sheet produced by the method of the present invention has high plastic workability and is capable of effectively decreasing the occurrence of cracks during working.

The present invention will be described in further detail below.

(Gist of Method of the Invention)

The method of the present invention is used for rolling a magnesium blank to produce a magnesium alloy sheet having a predetermined thickness. In this method, typically, the blank after casting is roughly rolled under conditions other than the conditions of controlled rolling and then finish-rolled under the above-described controlled conditions. In other words, the method of the present invention is applied to not only controlled rolling performed over the entire region of the rolling step after casing but also controlled rolling performed in a portion of the region.

(Surface Temperature Tr of Reduction Roll)

The surface temperature Tr of the reduction roll is 150° C. to 180° C. At the surface temperature lower than 150° C., when the rolling reduction per pass is increased, fine crocodiling may occur in a direction perpendicular to the transfer direction of the blank during rolling of the blank. On the other hand, at the temperature higher than 180° C., strain of the blank, which has been accumulated in previous rolling, is removed by recrystallization of the alloy crystal grains, thereby decreasing the amount of working strain and causing difficulty in making fine the crystal grains.

The surface temperature of the reduction roll can be controlled by a method of disposing a heating element such as a heater in the reduction roll or a method of spraying hot air onto the surface of the reduction roll.

(Surface Temperature Tb of Blank)

The surface temperature Tb (° C.) of the magnesium alloy blank immediately before insertion into the reduction roll satisfies the following equation:

$$8.33\times M+135\leqq Tb\leqq 8.33\times M+165$$

wherein $1.0\leqq M\leqq 10.0$.

In other words, the lower limit of the surface temperature Tb is about 140° C., and the upper limit is about 248° C. The temperature Tb depends on the Al content N (% by mass) in the magnesium alloy. Specifically, for ASTM standard AZ31, the temperature Tb may be set to about 160° C. to 190° C., while for AZ91, the temperature Tb may be set to about 210° C. to 247° C. At the temperature lower than the lower limit of each composition, like in a reduction roll at a lower surface temperature, fine crocodiling may occur in the direction perpendicular to the transfer direction of the blank. While at the temperature higher than the upper limit of each composition, strain of the blank, which has been accumulated in previous rolling, is removed by recrystallization of the alloy crystal grains during the rolling work, thereby decreasing the amount of working strain and causing difficulty in making fine the crystal grains.

Even when the surface temperature Tb of the blank falls in the above-described specified range, for example, with the reduction roll surface at room temperature, the surface temperature of the blank is decreased at the time of contact with the roll, thereby producing cracks in the surface of the blank. By specifying not only the surface temperature of the reduction roll but also the surface temperature of the blank, the occurrence of cracks can be effectively suppressed.

(Rolling Reduction of Controlled Rolling)

The total rolling reduction of controlled rolling is preferably 10% to 75%. The total rolling reduction is represented by (thickness of sheet before controlled rolling−thickness of sheet after controlled rolling)/(thickness before controlled rolling)×100. When the total rolling reduction is less than. 10%, the working strain of a working object is decreased, and the effect of making fine the crystal grains is decreased. Conversely, when the total rolling reduction exceeds 75%, the working strain near the surface of the working object is increased, and thus cracking may occur. For example, when the final thickness of the sheet is 0.5 mm, a sheet material of 0.56 to 2.0 mm in thickness may be subjected to controlled rolling. More preferably, the total rolling reduction of controlled rolling ranges from 20% to 50%.

Furthermore, the rolling reduction per pass (average rolling reduction per pass) of controlled rolling is preferably about 5% to 20%. When the rolling reduction per pass is excessively low, efficient rolling is difficult, while when the rolling reduction per pass is excessively high, defects such as cracks easily occur in the rolling object.

(Other Rolling Conditions)

A plurality of the above-mentioned controlled rolling passes is performed. Among the plurality of passes, at least one pass is preferably performed in a direction reverse to the rolling direction of the other passes. By rolling in the reverse direction, working strain is easily uniformly introduced into the working object in comparison to a plurality of rolling passes in the same direction. As a result, generally, variations in the crystal grain size after final heat treatment performed after the controlled rolling can be decreased.

In addition, as described above, rolling of the blank generally includes rough rolling and finish rolling. In this case, at least the finish rolling is preferably the controlled rolling. In view of further improvement in plastic workability, the controlled rolling is preferably performed over the entire region of the rolling step. However, the finish rolling is preferably the controlled rolling because the finish rolling is most concerned in suppressing coarsening of the crystal grains of the final resulting magnesium alloy sheet.

In other words, rough rolling other than finish rolling is restricted by the rolling conditions of controlled rolling. In particular, the surface temperature of the blank to be roughly rolled is not particularly limited. The surface temperature and rolling reduction of the blank to be roughly rolled may be controlled to select conditions for decreasing as much as possible the crystal grain size of the alloy sheet. For example, when the thickness of the blank before rolling and the thickness of the final sheet are 4.0 mm and 0.5 mm, respectively, the blank may be roughly rolled to a thickness of 0.56 mm to 2.0 mm and then finish-rolled.

In particular, under the rough rolling conditions in which the surface temperature of the reduction roll is set to 180° C. or more, and the rolling reduction per pass is increased, it is expected that the working efficiency of rough rolling is increased. In this case, for example, the rolling reduction per pass is preferably 20% to 40%. However, even when the surface temperature of the reduction roll is 180° C. or more, the surface temperature is preferably 250° C. or less in order to suppress recrystallization of the alloy crystal grains.

In addition, in the rough rolling step, preferably, the surface temperature Tb of the blank immediately before the insertion into the reduction roll is 300° C. or more, and the surface temperature Tr of the reduction roll is 180° C. or more. In this case, the sheet after rough rolling has an improved surface state without edge cracks. When the blank surface temperature and the roll surface temperature are 300° C. or less and less than 180° C., respectively, the rolling reduction cannot be increased, thereby decreasing the working efficiency of the rough rolling step. Although the upper limit of the blank surface temperature is not particularly limited, the surface state of the sheet after rough rolling may be degraded at a higher surface temperature. Therefore, the surface temperature is preferably 400° C. or less. Although the upper limit of the surface temperature of the roll for rough rolling is not particularly limited, the roll itself may be damaged by thermal fatigue at a higher temperature. Therefore, the surface temperature of the roll is preferably 300° C. or less.

When the rolling reduction per pass of rough rolling within the above-described temperature range is 20% to 40%, variation in grain size of the magnesium alloy sheet finish-rolled after rough rolling can be desirably decreased. When the rolling reduction per pass of rough rolling is less than 20%, the effect of decreasing variation in grain size after rolling is decreased, while when the rolling reduction exceeds 40%, edge cracks occur at the edge of the magnesium alloy sheet during rolling. The number of passes (pass number) of rolling with a rolling reduction within in this range is preferably at least 2 because one pass of rolling exhibits the low effect.

Furthermore, in rolling (initial rough rolling) of the cast blank, it is preferred to increase the temperature of the blank and increase the rolling reduction within the above-described rolling reduction range so that in rough rolling immediately before finish rolling, the blank temperature is about 300° C., and the rolling reduction is about 20%.

Rough rolling under the above-mentioned conditions can improve the plastic workability of the magnesium alloy sheet obtained by finish rolling in succession to the rough rolling. Specifically, it is possible to improve the surface state of the alloy sheet, suppress the occurrence of edge cracks, and decrease variation in crystal grain size of the alloy sheet. Also, the amount of segregation in the magnesium alloy sheet can be decreased.

(Blank)

The blank used in rolling in the present invention may be composed of a magnesium alloy containing Al, and the other components are not particularly limited. For example, a variety of materials, such as ASTM standard AZ, AM, and AS alloys, can be preferably used.

A method for producing the magnesium alloy blank is not particularly limited. For example, a blank prepared by an ingot casting method, an extrusion method, or a twin-roll casting method, may be used.

In the ingot casting method for producing the blank, for example, an ingot of about 150 mm to 300 mm in thickness is cast, and the cast ingot is hot-rolled after cutting of the surface of the cast ingot. The ingot casting method is suitable for mass production and capable of producing the blank at low cost.

In the extrusion method for producing the blank, for example, a billet of about 300 mm in diameter is cast, and the resultant billet is re-heated and then extruded. The extrusion method includes strong compression of the billet during extrusion and thus can crush crystals in the billet to some extent, the crystals easily causing starting points of cracking during subsequent rolling of the blank and plastic working of the rolled material.

In twin roll casting method for producing the blank, a melt is supplied from an inlet between a pair of rolls with the peripheral surfaces opposed to each other, and a solidified blank is delivered as a thin sheet from an outlet.

Among the blanks prepared by these three methods, the blank prepared by the twin roll casting method is preferably used. The twin-roll casting method is capable of quick solidification using twin rolls and thus causes little internal defects such as oxides and segregation in the resultant blank. In particular, after a rolled sheet having a final thickness of 1.2 mm or less is produced, defects which adversely affect subsequent plastic working such as press working can be eliminated. More specifically, crystals of 10 μm or more in diameter do not remain in the rolled sheet. In addition, a blank containing a small amount of crystals can be obtained regardless of the alloy composition such as AZ31 or AZ91. Furthermore, a thin sheet can be obtained using a material difficult to work, and thus the number of subsequent rolling steps of the blank can be decreased to decrease the cost.

(Other Working Conditions)

As another working condition, if required, solution treatment of the blank may be performed before rolling. The conditions of the solution treatment include, for example, 380° C. to 420° C. and about 60 minutes to 600 minutes and preferably 390° C. to 410° C. and about 360 minutes to 600 minutes. This solution treatment can decrease segregation. In particular, a magnesium alloy having a high Al content corresponding to AZ91 is preferably subjected to solution treatment for a long time.

If required, strain relief annealing may be performed in the rolling step (which may not be controlled rolling). The strain relief annealing is preferably performed between passes in a portion of the rolling step. The stage in the rolling step in which the strain relief treatment is performed and the number of strain relief treatments may be appropriately selected in view of the amount of strain accumulated in the magnesium alloy sheet. The strain relief treatment permits smooth rolling in the subsequent pass. The strain relief treatment conditions include, for example, 250° C. to 350° C. and about 20 minutes to 60 minutes.

Furthermore, the rolled material after the whole rolling work is preferably finally annealed. Since the crystal structure of the magnesium alloy sheet after finish rolling contains sufficiently accumulated working strain, fine recrystallization occurs in final annealing. Namely, even the alloy sheet which has been finally annealed to relieve strain has a fine recrystallized structure and is thus maintained in a high-strength state. Also, when the structure of the alloy sheet is previously recrystallized, a large change in the crystal structure, such as coarsening of the crystal grains in the structure of the alloy sheet, does not occur after plastic working at a temperature of about 250° C. Therefore, in the finally annealed magnesium alloy, a portion plastically deformed by plastic working can be improved in strength by work hardening, and a portion not plastically deformed can be maintained at the strength before the working. The final annealing conditions include 200° C. to 350° C. and about 10 minutes to 60 minutes. Specifically, when the Al content and zinc content in a magnesium alloy are 2.5 to 3.5% and 0.5 to 1.5%, respectively, the final annealing is preferably performed at 220° C. to 260° C. for 10 minutes to 30 minutes. When the Al content and zinc content in a magnesium alloy are 8.5 to 10.0% and 0.5 to 1.5%, respectively, the final annealing is preferably performed at 300° C. to 340° C. for 10 minutes to 30 minutes.

(Centerline Segregation)

In the sheet produced from a twin-roll cast material, segregation occurs in a central portion in the thickness direction during casting. In an Al-containing magnesium alloy, a segregated substance is an intermetallic compound mainly composed of the composition $Mg_{17}Al_{12}$, and the higher the impurity content in the magnesium alloy, the more segregation occurs. For example, in an ASTM standard AZ alloy, the amount of segregation in AZ91 having an Al content of about 9% by mass is larger than that of AZ31 having an Al content of about 3% by mass. Even in the AZ91 causing larger segregation, the length of segregation in the thickness direction of the magnesium alloy sheet can be dispersed to 20 μm or less by solution treatment under appropriate conditions before the above-described rough rolling step and finish rolling. The expression "segregation is dispersed" means that linear segregation is divided in the thickness direction and in the length direction. The criterion for the length of segregation in the thickness direction which causes no trouble in press working is 20 μm or less. Therefore, the length of segregation in the thickness direction is preferably further decreased to be smaller than 20 μm, and it is thus supposed that the strength property is improved by dispersing the maximum length of segregation to a length smaller than the crystal grain size of the base metal.

(Mechanical Properties of Magnesium Alloy Sheet)

When strain is accumulated in the rolling step and not removed by a heat treatment in producing the magnesium alloy sheet, tensile strength can be easily controlled to 360 MPa. However, in this case, it is difficult to control the elongation of the alloy sheet to 10% or more. Specifically, when the elongation at breakage at room temperature is less than 15%, plastic workability is low, and damages such as cracks or flaws occur in press forming at a temperature of as low as 250° C. or less. On the other hand, when the elongation at breakage of the magnesium alloy sheet at room temperature is 15% or more, the elongation at breakage at 250° C. of the alloy sheet is 100% or more, and substantially no damage such as surface cracks or flaws occurs in the magnesium alloy sheet in press forming. The method for producing the magnesium alloy sheet of the present invention is effective in producing a magnesium alloy sheet having the above-described mechanical properties. In particular, even by using a magnesium alloy having a high Al content M of 8.5 to 10.0% by mass (further having a zinc content of 0.5 to 1.5% by mass), a magnesium alloy sheet having a tensile strength of 360 MPa or more, a yield strength of 270 MPa or more, and an elongation at breakage of 15% or more at room temperature can be produced. The method for producing the magnesium alloy sheet of the present invention can produce a magnesium alloy sheet having a yield ratio of 75% or more.

The magnesium alloy sheet is preferably plastically worked in a temperature range in which the mechanical properties of the alloy sheet are not significantly changed by recrystallization in the structure of the alloy sheet during the plastic working. For example, a magnesium alloy sheet containing 1.0 to 10.0% by mass of Al is preferably plastically worked at a temperature of about 250° C. or less. In the method for producing the magnesium alloy sheet of the present invention, a magnesium alloy sheet having an Al content M of 8.5 to 10.0% by mass and a zinc content of 0.5 to 1.5% by mass can be made to have a tensile strength of 120 MPa or more and an elongation at breakage of 80% or more at 200° C. and a tensile strength of 90 MPa or more and an elongation at breakage of 100% or more at 250° C. Therefore, the method is suitable for plastic working, particularly high deformation such as press forming. Furthermore, in the method for producing the magnesium alloy sheet of the present invention, a magnesium alloy sheet corresponding to AZ31 can be made to have a tensile strength of 60 MPa or more and an elongation at breakage of 120% or more at 250° C.

Advantage of the Invention

As described above, the method of the present invention exhibits the following advantages:

In the method of the present invention, the temperature of the blank and the temperature of the reduction roll in rolling are specified so that rolling can be performed within a range causing no recrystallization of the crystal grains of the magnesium alloy used. It is thus possible to suppress coarsening of the crystal gains of the alloy and permitting rolling causing little cracking in the surface of the blank used. Also, it is possible to decrease the amount of segregation in a central portion of the blank and decrease variation in grain size of the crystal grains.

In particular, when the blank prepared by the twin-roll casting method is rolled, crystals serving as starting points of cracking little occur, thereby producing no crack or permitting plastic working causing substantially no cracking.

The magnesium alloy sheet of the present invention has the following characteristics:

The magnesium alloy sheet of the present invention has very excellent plastic workability because it is composed of fine crystal grains.

The magnesium alloy sheet of the present invention simultaneously satisfies a tensile strength of 360 MPa or more, a yield strength of 270 MPa or more, and an elongation at breakage of 15% or more and thus produces no problem even in press forming.

BEST MODE FOR CARRYING OUT THE INVENTION

An embodiment of the present invention will be described below.

Test Example 1

A magnesium alloy blank having a thickness of 4 mm and a composition corresponding to AZ31 containing Mg, 3.0% of Al, and 1.0% of Zn (% by mass) was prepared by the twin-roll continuous casting method. The blank was roughly rolled to a thickness of 1 mm to prepare a roughly rolled sheet having an average crystal grain size of 6.5 μm. Rough rolling was performed by pre-heating the blank to 250° C. to 350° C. and then rolling the blank with a reduction roll at room temperature. The average crystal grain size was determined by the calculation expression described in JIS G0551. Next, the roughly rolled sheet was finish-rolled to a thickness of 0.5 mm under various conditions. Each of the finish-rolled sheets was finally heat-treated at 250° C. for 30 minutes, and a disk having a diameter of 92 mm was cut out from each heat-treated material and used as an evaluation sample.

Next, the observation surface of each sample was buffed (diamond abrasive grains #200) and then etched to observe the structure and measure the average crystal grain size in the field of view of an optical microscope with a magnification of 400×.

Furthermore, each sample was drawn using a cylindrical punch and a die having a cylindrical hole engaging with the punch under the following conditions:

Mold set temperature: 200° C.

Punch diameter: 40.0 mm (tip R: Rp=4 mm)

Die hole diameter: 42.5 mm (shoulder R: Rd=4 mm)

Clearance: 1.25 mm

Molding rate: 2.0 mm/min

Drawing ratio: 2.3

Here, Rp is the radius of a curve constituting the punch outer periphery in a longitudinal section of the punch tip and Rd is the radius of a curve constituting the die hole opening in a longitudinal section of the die. The drawing ratio is defined as (diameter of sample/diameter of punch).

The finish rolling conditions and the test results are summarized in Table I. In this table, each designation means the following:

Sheet temperature: the surface temperature of the blank immediately before finish rolling.

Roll temperature: the surface temperature of the reduction roll for finish rolling.

Rolling direction: "Constant" means that all rolling passes were performed in the same direction, and "R" means that the rolling direction was reversed in every rolling pass.

Average rolling reduction per pass: total rolling reduction (50%)/number of times of rolling from a thickness of 1 mm to a thickness of 0.5 mm.

Sheet surface state: Symbol "A" means no occurrence of cracks or wrinkles in a rolled material; symbol "B", the occurrence of little crocodiling; and symbol "C", the occurrence of cracks.

Edge crack: Symbol "A" means no occurrence of cracks at the edge of a rolled material; symbol "B", the occurrence of only little cracks; and symbol "C", the occurrence of cracks.

Drawability: Symbol "A" means no occurrence of cracks at the corners of a produced good; Symbol "B", the occurrence of wrinkles but no crack; and symbol "C", the occurrence of cracks or breakage.

This table indicates that all samples finish-rolled under the controlled rolling conditions specified in the present invention have small average grain sizes, neither edge crack nor fine crack in the surfaces, and excellent drawability. The crystals in the samples according to the present invention have a size of 5 μm or less.

Test Example 2

Next, the same blank having a thickness of 4 mm as in Test example 1 was prepared and then roughly rolled to predetermined thicknesses to prepare roughly rolled sheets having different thicknesses. The rough rolling was performed by pre-heating the blank at 250° C. to 350° C. and then rolling the blank with a reduction roll at room temperature. Each of the roughly rolled sheets was finish-rolled to a final sheet thickness of 0.5 mm with different total rolling reductions to prepare finish-rolled sheets. The finish rolling was performed under the conditions in which the surface temperature of each roughly rolled sheet was 160° C. to 190° C. immediately before finish rolling, and the surface temperature a finish reduction roll was controlled in the range of 150° C. to 180° C. Next, each of the finish-rolled materials was heat-treated at 250° C. for 30 minutes by the same method as in Test example 1 to form an evaluation sample.

For these samples, the measurement of the average crystal grain size, the evaluation of the sheet surface state, the evaluation of edge cracks, and the overall evaluation of these evaluation results were carried out by the same methods as in Test example 1. The rolling reduction per pass and the total rolling reduction of finish rolling, and the evaluation results are shown in Table II. In this table, the terms "Sheet surface state" and "Edge crack" mean the same as in Test example 1. The term "Total rolling reduction" means the total rolling reduction of finish rolling from the thickness of the roughly rolled material to the final sheet thickness, i.e., the total rolling reduction of rolling at a sheet surface temperature of 160° C. to 190°. However, the numerical value in parentheses shown in No. 2-1 indicates that the roughly rolled sheet was finish-rolled at a sheet surface temperature of 220° C.

TABLE I

| Sample No. | Sheet temperature (° C.) | Roll temperature (° C.) | Rolling direction | Average rolling reduction per pass (%) | Sheet surface state | Edge crack | Average crystal grain size (μm) | Drawability |
|---|---|---|---|---|---|---|---|---|
| 1-1 | 140 | 175 | R | 8 | C | C | 4.1 | C |
| 1-2 | 150 | 173 | R | 7 | B | B | 4.1 | B |
| 1-3 | 160 | 168 | R | 8 | A | A | 4.2 | A |
| 1-4 | 170 | 170 | R | 6 | A | A | 4.3 | A |
| 1-5 | 180 | 169 | R | 7 | A | A | 4.3 | A |
| 1-6 | 190 | 175 | R | 8 | A | A | 4.5 | A |
| 1-7 | 200 | 178 | R | 7 | A | A | 5.6 | C |
| 1-8 | 210 | 176 | R | 7 | A | A | 6.0 | C |
| 1-9 | 220 | 175 | R | 7 | A | A | 7.7 | C |
| 1-10 | 230 | 175 | R | 8 | A | A | 8.0 | C |
| 1-11 | 175 | 166 | R | 14 | A | B | 3.8 | A |
| 1-12 | 180 | 168 | R | 14 | A | B | 3.7 | A |
| 1-13 | 176 | 171 | R | 22 | B | B | 3.4 | B |
| 1-14 | 178 | 174 | R | 20 | A | B | 3.5 | B |
| 1-15 | 170 | 168 | Constant | 7 | A | B | 4.4 | B |
| 1-16 | 180 | 171 | Constant | 7 | A | B | 4.5 | B |

Rolling direction: "R" means the reverse rolling direction.

TABLE II

| Sample No. | Average rolling reduction per pass (%) | Total rolling reduction at 160 to 190° C. (%) | Sheet surface state | Edge crack | Average crystal grain size (μm) | Overall evaluation |
|---|---|---|---|---|---|---|
| 2-1 | 7 | 0 (220° C.) | A | A | 7.7 | C |
| 2-2 | 4 | 4 | A | A | 6.5 | C |
| 2-3 | 8 | 8 | A | A | 6.2 | C |
| 2-4 | 5 | 10 | A | A | 5.0 | A |
| 2-5 | 8 | 18 | A | A | 4.8 | A |
| 2-6 | 7 | 20 | A | A | 4.7 | A |
| 2-7 | 9 | 24 | A | A | 4.6 | A |
| 2-8 | 12 | 24 | A | A | 4.5 | A |
| 2-9 | 10 | 28 | A | A | 4.8 | A |
| 2-10 | 14 | 28 | A | B | 4.6 | A |
| 2-11 | 28 | 28 | B | B | 4.6 | A |
| 2-12 | 28 | 28 | B | B | 4.5 | B |
| 2-13 | 16 | 32 | B | B | 4.5 | B |
| 2-14 | 9 | 35 | A | A | 4.4 | A |
| 2-15 | 8 | 40 | A | A | 4.4 | A |
| 2-16 | 8 | 45 | A | A | 4.4 | A |
| 2-17 | 15 | 45 | A | A | 4.0 | A |
| 2-18 | 8 | 50 | A | A | 4.3 | A |
| 2-19 | 15 | 50 | B | B | 3.9 | B |
| 2-20 | 22 | 50 | B | B | 3.7 | B |
| 2-21 | 9 | 60 | B | A | 3.9 | B |
| 2-22 | 12 | 65 | B | B | 3.8 | B |
| 2-23 | 23 | 70 | B | B | 3.8 | B |
| 2-24 | 15 | 70 | B | B | 3.7 | B |
| 2-25 | 10 | 76 | C | C | 3.7 | C |
| 2-26 | 10 | 80 | C | C | 3.6 | C |

This table indicates that the samples with total rolling reductions of 10% to 75% exhibit excellent results in the overall evaluation.

Test Example 3-1

A magnesium alloy blank having a thickness of 4 mm and a composition corresponding to AZ91 containing Mg, 9.0% of Al, and 1.0% of Zn (% by mass) was prepared by the twin-roll continuous casting method. The blank was roughly rolled to a predetermined thickness of 1 mm to prepare a roughly rolled sheet having an average crystal grain size of 6.8 μm. The rough rolling was performed by pre-heating the blank at 300° C. to 380° C. and then rolling the blank with a reduction roll at room temperature. The average crystal grain size was determined by the calculation expression described in JIS G0551. Next, the roughly rolled sheet was finish-rolled to a thickness of 0.5 mm under various conditions. Each of the finish-rolled sheets was finally heat-treated at 320° C. for 30 minutes, and a disk having a diameter of 92 mm was cut out from each heat-treated material and used as an evaluation sample.

Next, the observation surface of each sample was buffed (diamond abrasive grains #200) and then etched to observe the structure and measure the average crystal grain size in the field of view of an optical microscope with a magnification of 400×.

Furthermore, each sample was drawn using a cylindrical punch and a die having a cylindrical hole engaging with the punch under the same conditions as in Test Example 1 except that the mold set temperature was 250° C. The finish rolling conditions and the test results are summarized in Table III. In this table, each designation means the same as in Test Example 1.

TABLE III

| Sample No. | Sheet temperature (° C.) | Roll temperature (° C.) | Rolling direction | Average rolling reduction per pass (%) | Sheet surface state | Edge crack | Average crystal grain size (μm) | Drawability |
|---|---|---|---|---|---|---|---|---|
| 3-1 | 190 | 173 | R | 7 | C | C | 4.2 | C |
| 3-2 | 200 | 175 | R | 8 | B | B | 4.3 | B |
| 3-3 | 210 | 169 | R | 8 | A | A | 4.3 | A |
| 3-4 | 220 | 170 | R | 7 | A | A | 4.3 | A |
| 3-5 | 230 | 167 | R | 7 | A | A | 4.4 | A |
| 3-6 | 240 | 170 | R | 8 | A | A | 4.5 | A |
| 3-7 | 250 | 178 | R | 7 | A | A | 5.8 | C |
| 3-8 | 260 | 175 | R | 7 | A | A | 6.1 | C |
| 3-9 | 270 | 174 | R | 7 | A | A | 7.8 | C |
| 3-10 | 280 | 176 | R | 8 | A | A | 8.1 | C |
| 3-11 | 225 | 166 | R | 15 | A | B | 4.0 | A |
| 3-12 | 230 | 160 | R | 15 | A | B | 4.1 | A |
| 3-13 | 226 | 171 | R | 23 | B | B | 4.1 | B |
| 3-14 | 228 | 174 | R | 20 | A | B | 3.9 | B |
| 3-15 | 220 | 169 | Constant | 8 | A | B | 4.5 | B |
| 3-16 | 230 | 171 | Constant | 7 | A | B | 4.7 | B |

Rolling direction: "R" means the reverse rolling direction.

Test Example 3-2

A magnesium alloy blank having a different Al content from that in Test Example 3-1 was used for examining the influences of the blank temperature and roll temperature in finish rolling by the same method as in Test Example 3-1. The producing conditions other than the finish rolling conditions and the evaluation methods for the magnesium alloy sheets were the same as in Test Example 3-1. The Al content of the magnesium alloy blank was 9.8% by mass, and the Zn content thereof was 1.0% by mass. The finish rolling conditions and the test results are summarized in Table IV.

TABLE IV

| Sample No. | Sheet temperature (° C.) | Roll temperature (° C.) | Rolling direction | Average rolling reduction per pass (%) | Sheet surface state | Edge crack | Average crystal grain size (μm) | Drawability |
|---|---|---|---|---|---|---|---|---|
| 3-17 | 190 | 173 | R | 7 | C | C | 4.3 | C |
| 3-18 | 200 | 175 | R | 8 | B | B | 4.3 | B |
| 3-19 | 230 | 170 | R | 7 | A | A | 4.4 | A |
| 3-20 | 260 | 175 | R | 7 | A | A | 6.3 | C |
| 3-21 | 280 | 176 | R | 8 | A | A | 8.1 | C |
| 3-22 | 230 | 175 | R | 15 | A | A | 4.2 | A |
| 3-23 | 230 | 135 | R | 15 | C | B | 4.1 | C |
| 3-24 | 230 | 175 | R | 25 | B | B | 3.9 | B |
| 3-25 | 230 | 175 | Constant | 7 | A | B | 4.7 | B |

Rolling direction: "R" means the reverse rolling direction.

Tables III and IV indicate that all samples finish-rolled under the controlled rolling conditions specified in the present invention exhibit small average grains sizes, neither edge crack nor fine crack in the surfaces, and excellent drawability.

Test Example 4-1

Next, the same blank having a thickness of 4 mm as in Test example 3-1 was prepared and then roughly rolled to predetermined thicknesses to prepare roughly rolled sheets having different thicknesses. The rough rolling was performed by pre-heating the blank at 300° C. to 380° C. and then rolling the blank with a reduction roll at room temperature. Each of the roughly rolled sheets was finish-rolled to a final sheet thickness of 0.5 mm with different total rolling reductions to prepare finish-rolled sheets. The finish rolling was performed under the conditions in which the surface temperature of each roughly rolled sheet was 210° C. to 240° C. immediately before finish rolling, and the surface temperature of a finish reduction roll was controlled in the range of 150° C. to 180° C. Next, each of the finish-rolled materials was heat-treated at 320° C. for 30 minutes by the method as in Test Example 3-1 to form an evaluation sample.

For these samples, the measurement of the average crystal grain size, the evaluation of the sheet surface state, the evaluation of edge cracks, and the overall evaluation of these evaluation results were carried out by the same methods as in Test Example 3-1. The rolling reduction per pass and the total rolling reduction of finish rolling, and the evaluation results are shown in Table V. In this table, the terms "Sheet surface state" and "Edge crack" mean the same as in Test Example 1. The term "total rolling reduction" means the total rolling reduction of finish rolling from the thickness of the roughly rolled material to the final sheet thickness, i.e., the total rolling reduction of rolling at a sheet surface temperature of 210° C. to 240°. However, the numerical value in parentheses shown in No. 4-1 indicates that the roughly rolled sheet was finish-rolled at a sheet surface temperature of 270° C.

TABLE V

| Sample No. | Average rolling reduction per pass (%) | Total rolling reduction at 210 to 240° C. (%) | Sheet surface state | Edge crack | Average crystal grain size (μm) | Overall evaluation |
|---|---|---|---|---|---|---|
| 4-1 | 7 | 0 (270° C.) | A | A | 7.9 | C |
| 4-2 | 4 | 4 | A | A | 6.4 | C |
| 4-3 | 8 | 8 | A | A | 6.3 | C |
| 4-4 | 5 | 10 | A | A | 5.2 | A |
| 4-5 | 8 | 18 | A | A | 4.8 | A |
| 4-6 | 7 | 20 | A | A | 4.8 | A |
| 4-7 | 9 | 24 | A | A | 4.6 | A |
| 4-8 | 12 | 24 | A | A | 4.5 | A |
| 4-9 | 10 | 28 | A | A | 4.8 | A |
| 4-10 | 14 | 28 | A | B | 4.7 | A |
| 4-11 | 28 | 28 | B | B | 4.7 | A |
| 4-12 | 28 | 28 | B | B | 4.5 | B |
| 4-13 | 16 | 32 | B | B | 4.5 | B |
| 4-14 | 9 | 35 | A | A | 4.4 | A |
| 4-15 | 8 | 40 | A | A | 4.4 | A |
| 4-16 | 8 | 45 | A | A | 4.4 | A |
| 4-17 | 15 | 45 | A | A | 4.0 | A |
| 4-18 | 8 | 50 | A | A | 4.5 | A |
| 4-19 | 15 | 50 | B | B | 4.2 | B |
| 4-20 | 20 | 50 | B | B | 4.1 | B |

TABLE V-continued

| Sample No. | Average rolling reduction per pass (%) | Total rolling reduction at 210 to 240° C. (%) | Sheet surface state | Edge crack | Average crystal grain size (μm) | Overall evaluation |
|---|---|---|---|---|---|---|
| 4-21 | 9 | 60 | B | A | 4.0 | B |
| 4-22 | 12 | 65 | B | B | 4.0 | B |
| 4-23 | 12 | 70 | B | B | 3.9 | B |
| 4-24 | 15 | 70 | B | B | 3.9 | B |
| 4-25 | 8 | 76 | C | C | 3.9 | C |
| 4-26 | 10 | 80 | C | C | 3.8 | C |

Test Example 4-2

A magnesium alloy blank having a different Al content from that in Test Example 4-1 was used for examining the influences of the average rolling reduction per pass and total rolling reduction of finish rolling by the same method as in Test Example 4-1. The producing conditions other than the finish rolling conditions and the evaluation method for the magnesium alloy sheets were the same as in Test Example 4-1. The Al content of the magnesium alloy blank was 9.8% by mass, and the Zn content thereof was 1.0% by mass. The finish rolling conditions and the test results are summarized in Table VI.

TABLE VI

| Sample No. | Average rolling reduction per pass (%) | Total rolling reduction at 217 to 247° C. (%) | Sheet surface state | Edge crack | Average crystal grain size (μm) | Overall evaluation |
|---|---|---|---|---|---|---|
| 4-27 | 8 | 0 (270° C.) | A | A | 8.0 | C |
| 4-28 | 8 | 8 | A | A | 6.5 | C |
| 4-29 | 8 | 18 | A | A | 4.8 | A |
| 4-30 | 10 | 28 | A | A | 4.9 | A |
| 4-31 | 28 | 28 | B | B | 4.6 | B |
| 4-32 | 8 | 40 | A | A | 4.4 | A |
| 4-33 | 8 | 50 | A | A | 4.5 | A |
| 4-34 | 22 | 50 | B | B | 4.1 | B |
| 4-35 | 14 | 65 | B | B | 4.1 | B |
| 4-36 | 10 | 80 | C | C | 4.0 | C |

Tables V and VI indicate that the samples with total rolling reductions of 10% to 75% exhibit excellent results in the overall evaluation.

(Summary of Test Examples 1 to 4)

On the basis of the results of Test Examples 1 to 4, the relation between the surface temperature Tb (° C.) of the blank immediately before the insertion into the reduction roll and the Al content M (% by mass) in the magnesium alloy constituting the blank was represented by graphing. As a result, it was found that when the surface temperature Tb of the blank satisfies the following expression, controlled rolling with a reduction roll at a surface temperature Tr of 150° C. to 180° C. produces a magnesium alloy sheet containing fine crystal grains and having excellent plastic workability.

$$8.33\times M+135\leqq Tb\leqq 8.33\times M+165$$

wherein $1.0\leqq M\leqq 10.0$.

Test Example 5

Furthermore, magnesium alloy sheets (corresponding AZ31) were produced using different methods for producing the blank and different rolling conditions. The method for producing the blank and the rolling conditions were as follows:

<Method for Producing Blank>

A1: A blank having a thickness of 4 mm was prepared by twin-roll continuous casting.

A2: An ingot having a thickness of about 200 mm was cast, cut at the surface thereof, and then hot-rolled to prepare a blank having a thickness of 4 mm.

<Rolling Method>

B1: In rough rolling (thickness of 4 mm to 1 mm), the blank was pre-heated at 250° C. to 350° C. and then rolled with a reduction roll at room temperature. In controlled rolling as finish rolling (thickness of 1 mm to 0.5 mm), the surface temperature of the reduction roll was 150° C. to 180° C., and the surface temperature of the roughly rolled sheet immediately before the insertion into the reduction roll was 160° C. to 190° C.

B2: The blank was pre-heated at 300° C. to 400° C. and then rolled with a reduction roll at room temperature in all rolling passes (thickness of 4 mm to 0.5 mm).

The magnesium alloy sheet was rolled in each of the combinations of the above-described conditions shown in Table V and then the rolled sheet was finally heat-treated at 250° C. for 30 minutes. For the resultant magnesium alloy sheets, the measurement of the average crystal grain size, the evaluation of the sheet surface state, the evaluation of edge cracks, and the overall evaluation of these evaluation results were carried out. The results are shown in Table VII. The results of the overall evaluation are shown by symbols "A", "B", and "C" in the order from a good level.

TABLE VII

| Sample No. | Method for producing blank | Rolling method | Overall evaluation |
|---|---|---|---|
| 5-1 | A1 | B1 | A |
| 5-2 | A1 | B2 | C |

TABLE VII-continued

| Sample No. | Method for producing blank | Rolling method | Overall evaluation |
|---|---|---|---|
| 5-3 | A2 | B1 | B |
| 5-4 | A2 | B2 | C |

The results indicate that the predetermined controlled rolling using a blank prepared by twin-roll casting can produce a magnesium alloy sheet having excellent plastic workability.

Test Example 6

A magnesium alloy blank having a thickness of 4 mm and a composition corresponding to AZ31 containing Mg, 3.0% of Al, and 1.0% of Zn (% by mass) was prepared by the twin-roll continuous casting method. The blank was roughly rolled to a thickness of 1 mm under different conditions to prepare a plurality of roughly rolled sheets. The plurality of roughly rolled sheets was finish-rolled to a final thickness of 0.5 mm under the same conditions to prepare magnesium alloy sheets. The finish rolling was performed under the conditions in which the surface temperature of each roughly rolled sheet immediately before finish rolling was 160° C. to 190° C., and the surface temperature of a reduction roll was controlled in the range of 150° C. to 180° C. Also, the rolling reduction per pass was controlled to 15%. Each of the finish-rolled magnesium alloy sheets was heat-treated at 250° C. for 30 minutes and used as an evaluation sample. For each of the samples, the measurement of the average crystal grain size, the evaluation of the sheet surface state, and the evaluation of edge cracks were performed by the same method as in Test Example 1.

The finish rolling conditions and the test results are summarized in Table VIII. In this table, each designation means the following:

Sheet temperature: the surface temperature of the blank immediately before rough rolling.

Roll temperature: the surface temperature of the reduction roll for rough rolling.

Rolling reduction per pass: rolling reduction of rolling from thickness of 4 mm to 1.0 m/pass Sheet surface state: Symbol "A" means no occurrence of cracks or wrinkles in a rolled material; symbol "B", the occurrence of little crocodiling; and symbol "C", the occurrence of cracks.

The average crystal grain size was determined by the calculation expression described in JIS G0551.

TABLE VIII

| Sample No. | Temperature of roughly rolled sheet (° C.) | Temperature of rough reduction roll (° C.) | Rolling reduction/ pass (%) | Sheet surface state | Edge crack | Average crystal grain size (μm) | Overall evaluation |
|---|---|---|---|---|---|---|---|
| 6-1 | 200 | 150 | 10 | C | B | 4.8 | C |
| 6-2 | 200 | 150 | 20 | C | C | 4.5 | C |
| 6-3 | 250 | 150 | 10 | B | B | 4.8 | B |
| 6-4 | 250 | 180 | 20 | B | B | 4.6 | B |
| 6-5 | 300 | 150 | 10 | B | A | 4.7 | B |
| 6-6 | 300 | 150 | 20 | B | B | 4.5 | B |
| 6-7 | 300 | 180 | 20 | A | A | 4.4 | A |
| 6-8 | 300 | 200 | 20 | A | A | 4.4 | A |
| 6-9 | 300 | 250 | 20 | A | A | 4.3 | A |
| 6-10 | 320 | 150 | 20 | B | A | 4.4 | B |
| 6-11 | 320 | 180 | 20 | A | A | 4.4 | A |
| 6-12 | 320 | 200 | 20 | A | A | 4.3 | A |
| 6-13 | 350 | 150 | 20 | B | A | 4.4 | B |
| 6-14 | 350 | 200 | 20 | A | A | 4.5 | A |
| 6-15 | 350 | 250 | 20 | A | A | 4.5 | A |
| 6-16 | 380 | 150 | 20 | B | A | 4.3 | B |
| 6-17 | 380 | 180 | 20 | A | A | 4.4 | A |
| 6-18 | 380 | 250 | 20 | A | A | 4.5 | A |
| 6-19 | 380 | 250 | 30 | A | A | 4.3 | A |
| 6-20 | 400 | 150 | 20 | B | A | 4.3 | B |
| 6-21 | 400 | 100 | 20 | B | B | 4.3 | B |
| 6-22 | 400 | 50 | 20 | B | B | 4.2 | B |
| 6-23 | 400 | 25 | 20 | C | B | 4.2 | C |
| 6-24 | 400 | 25 | 30 | C | C | 4.0 | C |

Test Example 7-1

A magnesium alloy blank having a thickness of 4 mm and a composition corresponding to AZ91 containing Mg, 9.0% of Al, and 1.0% of Zn (% by mass) was prepared by the twin-roll continuous casting method. The blank was roughly rolled to a thickness of 1 mm under different conditions to prepare a plurality of roughly rolled sheets. The plurality of roughly rolled sheets was finish-rolled to a final thickness of 0.5 mm under the same conditions to prepare magnesium alloy sheets. The finish rolling was performed under the conditions in which the surface temperature of each roughly rolled sheet immediately before finish rolling was 210° C. to 240° C., and the surface temperature of a reduction roll was controlled in the range of 150° C. to 180° C. Also, the rolling reduction per pass was controlled to 15%. Each of the finish-rolled magnesium alloy sheets was heat-treated at 320° C. for 30 minutes and used as an evaluation sample. For each of the samples, the measurement of the average crystal grain size, the evaluation of the sheet surface state, and the evaluation of edge cracks were performed by the same method as in Test Example 6. Furthermore, overall evaluation was conducted on the basis of these evaluation results.

The rough rolling conditions and the test results are summarized in Table IX. In this table, each designation means the same as in Test Example 6.

TABLE IX

| Sample No. | Temperature of roughly rolled sheet (° C.) | Temperature of rough reduction roll (° C.) | Rolling reduction/ pass (%) | Sheet surface state | Edge crack | Average crystal grain size (μm) | Overall evaluation |
|---|---|---|---|---|---|---|---|
| 7-1 | 250 | 150 | 10 | C | B | 5.6 | C |
| 7-2 | 250 | 150 | 20 | C | C | 5.2 | C |
| 7-3 | 280 | 150 | 10 | B | B | 5.7 | B |
| 7-4 | 280 | 180 | 20 | B | B | 5.1 | B |
| 7-5 | 300 | 150 | 10 | B | A | 5.8 | B |
| 7-6 | 300 | 150 | 20 | B | B | 5.0 | B |
| 7-7 | 300 | 180 | 20 | A | A | 4.9 | A |
| 7-8 | 300 | 200 | 20 | A | A | 5.0 | A |
| 7-9 | 300 | 250 | 20 | A | A | 4.8 | A |
| 7-10 | 320 | 150 | 20 | B | A | 4.9 | B |
| 7-11 | 320 | 180 | 20 | A | A | 4.8 | A |
| 7-12 | 320 | 200 | 20 | A | A | 4.9 | A |
| 7-13 | 350 | 150 | 20 | B | A | 4.5 | B |
| 7-14 | 350 | 200 | 20 | A | A | 4.6 | A |
| 7-15 | 350 | 250 | 20 | A | A | 4.7 | A |
| 7-16 | 380 | 150 | 20 | B | A | 4.7 | B |
| 7-17 | 380 | 180 | 20 | A | A | 4.5 | A |
| 7-18 | 380 | 250 | 20 | A | A | 4.6 | A |
| 7-19 | 380 | 250 | 30 | A | A | 4.4 | A |
| 7-20 | 380 | 300 | 30 | A | A | 4.4 | A |
| 7-21 | 380 | 300 | 35 | A | A | 4.2 | A |
| 7-22 | 400 | 150 | 20 | B | A | 4.9 | B |
| 7-23 | 400 | 100 | 20 | B | B | 4.9 | B |
| 7-24 | 400 | 50 | 20 | B | B | 4.7 | B |
| 7-25 | 400 | 25 | 20 | C | B | 4.5 | C |
| 7-26 | 400 | 25 | 25 | C | C | 4.4 | C |

Test Example 7-2

A magnesium alloy blank having a different Al content from that in Test Example 7-1 was used for examining the influences of the temperature of the blank and the roll temperature in rough rolling by the same method as in Test Example 3-1. The producing conditions other than the rough rolling conditions and the evaluation method for the magnesium alloy sheets were the same as in Test Example 7-1. The Al content of the magnesium alloy blank was 9.8% by mass, and the Zn content thereof was 1.0% by mass. The finish rolling conditions and the test results are summarized in Table X.

TABLE X

| Sample No. | Temperature of roughly rolled sheet (° C.) | Temperature of rough reduction roll (° C.) | Rolling reduction/ pass (%) | Sheet surface state | Edge crack | Average crystal grain size (μm) | Overall evaluation |
|---|---|---|---|---|---|---|---|
| 7-28 | 250 | 160 | 10 | C | B | 5.7 | C |
| 7-29 | 280 | 180 | 20 | B | B | 5.2 | B |
| 7-30 | 300 | 160 | 20 | B | B | 5.0 | B |
| 7-31 | 300 | 180 | 20 | A | A | 4.9 | A |
| 7-32 | 300 | 250 | 20 | A | A | 4.8 | A |
| 7-33 | 320 | 160 | 20 | B | A | 4.9 | B |
| 7-34 | 320 | 200 | 20 | A | A | 4.9 | A |
| 7-35 | 350 | 160 | 20 | B | A | 4.5 | B |
| 7-36 | 350 | 250 | 20 | A | A | 4.7 | A |
| 7-37 | 380 | 160 | 20 | B | A | 4.7 | B |
| 7-38 | 380 | 300 | 30 | A | A | 4.4 | A |
| 7-39 | 380 | 320 | 30 | B | A | 4.1 | B |
| 7-40 | 400 | 160 | 20 | B | A | 5.0 | B |
| 7-41 | 400 | 100 | 20 | B | B | 5.1 | B |
| 7-42 | 400 | 25 | 20 | C | C | 4.5 | C |

Test Example 8

The same AZ31 blank (thickness, 4 mm) as that used in Test Example 6 was prepared and then roughly rolled to a thickness of 1 mm under different conditions to prepare a plurality of roughly rolled sheets. The roughly rolled sheets were finish-rolled to a final sheet thickness of 0.5 mm under the same conditions to prepare magnesium alloy sheets.

The rough rolling was performed under the conditions in which the surface temperature of each roughly rolled sheet immediately before rough rolling was 350° C., and the surface temperature of the rough reduction roll was controlled in the range of 200° C. to 230° C. During the rough rolling, the rolling reduction per pass was changed. On the other hand, the finish rolling was performed under the conditions in which the surface temperature of each roughly rolled sheet immediately before finish rolling was 160° C. to 190° C., the surface temperature of a finish reduction roll was controlled in the range of 150° C. to 180° C., and the rolling reduction per pass in the finish rolling was controlled to 15%.

Next, each of the finish-rolled sheets was heat-treated at 250° C. for 30 minutes by the same method as in Test Example 1 to form an evaluation sample. For these samples, the measurement of the average crystal grain size, the evaluation of the sheet surface state, the evaluation of edge cracks, and the evaluation of variation in grain size were performed by the same methods as in Test Example 6. Furthermore, the overall evaluation based on these evaluation results was carried out. The number of times of rough rolling with a rolling reduction per pass of 20% to 40% and the evaluation results are shown in Table XI. In this table, the terms "Sheet surface state" and "Edge crack" mean the same as in Test Example 6. The term "Number of times of rough rolling with rolling reduction or 20% of 40%" means the number of times of rough rolling with a rolling reduction of 20% to 40% at each time, and the term "Maximum rolling reduction per pass" means the maximum rolling reduction in a plurality of passes of rough rolling. The variation in gain size is shown on the basis of the following meaning:

Large . . . maximum grain size/minimum grain size≧2

Medium . . . 2≧maximum grain size/minimum grain size≧1.5

Small . . . maximum grain size/minimum grain size≦1.5

TABLE XI

| Sample No. | Number of times of rough rolling with rolling reduction of 20 to 40% | Maximum rolling reduction/ pass (%) | Sheet surface state | Edge crack | Average crystal grain size (μm) | Variation in grain size | Overall evaluation |
|---|---|---|---|---|---|---|---|
| 8-1 | 0 | 10 | A | A | 4.3 | Large | B |
| 8-2 | 0 | 18 | A | A | 4.2 | Large | B |
| 8-3 | 1 | 20 | A | A | 4.2 | Medium | B |
| 8-4 | 1 | 25 | A | A | 4.2 | Medium | B |
| 8-5 | 1 | 30 | A | A | 4.1 | Medium | B |
| 8-6 | 1 | 40 | A | A | 4.1 | Medium | B |
| 8-7 | 1 | 44 | B | C | 4.0 | Medium | C |
| 8-8 | 2 | 20 | A | A | 4.2 | Small | A |
| 8-9 | 2 | 27 | A | A | 4.1 | Small | A |
| 8-10 | 2 | 30 | A | A | 4.1 | Small | A |
| 8-11 | 2 | 36 | A | A | 4.0 | Small | A |
| 8-12 | 2 | 40 | A | A | 4.0 | Small | A |
| 8-13 | 2 | 43 | B | C | 4.0 | Small | C |
| 8-14 | 3 | 20 | A | A | 4.1 | Small | A |
| 8-15 | 3 | 30 | A | A | 4.0 | Small | A |
| 8-16 | 3 | 40 | A | A | 3.9 | Small | A |
| 8-17 | 3 | 43 | B | C | 3.9 | Small | A |
| 8-18 | 4 | 20 | A | A | 4.0 | Small | A |
| 8-19 | 4 | 30 | A | A | 4.0 | Small | A |
| 8-20 | 4 | 35 | A | A | 3.9 | Small | A |
| 8-21 | 4 | 42 | B | C | 3.9 | Small | C |
| 8-22 | 5 | 20 | A | A | 4.0 | Small | A |
| 8-23 | 5 | 30 | A | A | 4.0 | Small | A |
| 8-24 | 5 | 40 | A | A | 3.8 | Small | A |
| 8-25 | 6 | 20 | A | A | 4.0 | Small | A |

Test Example 9-1

The same AZ91 blank (thickness, 4 mm) as that used in Test Example 7-1 was prepared and then roughly rolled to a thickness of 1 mm under different conditions to prepare a plurality of roughly rolled sheets. The roughly rolled sheets were finish-rolled to a final sheet thickness of 0.5 mm under the same conditions to prepare magnesium alloy sheets.

The rough rolling was performed under the conditions in which the surface temperature of the blank immediately before rough rolling was 350° C., and the surface temperature of a rough reduction roll was controlled in the range of 200° C. to 230° C. During the rough rolling, the rolling reduction per pass was changed.

On the other hand, the finish rolling was performed under the conditions in which the surface temperature of each roughly rolled sheet immediately before finish rolling was 210° C. to 240° C., the surface temperature of a finish reduction roll was controlled in the range of 150° C. to 180° C., and the rolling reduction per pass in the finish rolling was controlled to 15%.

Next, each of the finish-rolled sheets was heat-treated at 320° C. for 30 minutes by the method as in Test Example 7-1 to form an evaluation sample. For these samples, the measurement of the average crystal grain size, the evaluation of the sheet surface state, the evaluation of edge cracks, and the evaluation of variation in grain size were performed by the same methods as in Test Example 6. Furthermore, the overall evaluation based on these evaluation results was carried out.

The number of times of rough rolling with a rolling reduction per pass of 20% to 40% and the evaluation results are shown in Table XII. In this table, the terms "Sheet surface state", "Edge crack", and "Variation in grain size" mean the same as in Test Example 8.

TABLE XII

| Sample No. | Number of times of rough rolling with rolling reduction of 20 to 40% | Maximum rolling reduction/ pass (%) | Sheet surface state | Edge crack | Average crystal grain size (μm) | Variation in grain size | Overall evaluation |
|---|---|---|---|---|---|---|---|
| 9-1 | 0 | 10 | A | A | 5.0 | Large | B |
| 9-2 | 0 | 18 | A | A | 4.9 | Large | B |
| 9-3 | 1 | 20 | A | A | 4.9 | Medium | B |
| 9-4 | 1 | 25 | A | A | 4.8 | Medium | B |
| 9-5 | 1 | 30 | A | A | 4.7 | Medium | B |
| 9-6 | 1 | 40 | A | A | 4.5 | Medium | B |
| 9-7 | 1 | 44 | B | C | 4.5 | Medium | C |
| 9-8 | 2 | 20 | A | A | 4.9 | Small | A |
| 9-9 | 2 | 27 | A | A | 4.8 | Small | A |
| 9-10 | 2 | 30 | A | A | 4.7 | Small | A |
| 9-11 | 2 | 36 | A | A | 4.6 | Small | A |
| 9-12 | 2 | 40 | A | A | 4.5 | Small | A |
| 9-13 | 2 | 43 | B | C | 4.5 | Small | C |
| 9-14 | 3 | 20 | A | A | 4.9 | Small | A |
| 9-15 | 3 | 30 | A | A | 4.8 | Small | A |
| 9-16 | 3 | 40 | A | A | 4.6 | Small | A |
| 9-17 | 3 | 43 | B | C | 4.5 | Small | C |
| 9-18 | 4 | 20 | A | A | 4.9 | Small | A |
| 9-19 | 4 | 30 | A | A | 4.8 | Small | A |
| 9-20 | 4 | 35 | A | A | 4.6 | Small | A |
| 9-21 | 4 | 42 | B | C | 4.4 | Small | C |
| 9-22 | 5 | 20 | A | A | 4.8 | Small | A |
| 9-23 | 5 | 30 | A | A | 4.7 | Small | A |
| 9-24 | 5 | 40 | A | A | 4.3 | Small | A |
| 9-25 | 6 | 20 | A | A | 4.6 | Small | A |

Test Example 9-2

A magnesium alloy blank having a different Al content from that in Test Example 9-1 was used for examining the influences of the temperature of the blank and the roll temperature in rough rolling by the same method as in Test Example 9-1. The producing conditions other than the rough rolling conditions and the evaluation method for the magnesium alloy sheets were the same as in Test Example 9-1. The Al content of the magnesium alloy blank was 9.8% by mass, and the Zn content thereof was 1.0% by mass. The finish rolling conditions and the test results are summarized in Table XIII.

TABLE XIII

| Sample No. | Number of times of rough rolling with rolling reduction of 20 to 40% | Maximum rolling reduction/ pass (%) | Sheet surface state | Edge crack | Average crystal grain size (μm) | Variation in grain size | Overall evaluation |
|---|---|---|---|---|---|---|---|
| 9-26 | 0 | 10 | A | A | 5.0 | Large | B |
| 9-27 | 1 | 25 | A | A | 4.9 | Medium | B |
| 9-28 | 1 | 40 | A | A | 4.6 | Medium | B |
| 9-29 | 1 | 43 | B | C | 4.6 | Medium | C |
| 9-30 | 2 | 20 | A | A | 4.9 | Small | A |
| 9-31 | 2 | 28 | A | A | 4.8 | Small | A |
| 9-32 | 2 | 38 | A | A | 4.5 | Small | A |
| 9-33 | 2 | 44 | B | C | 4.4 | Small | C |
| 9-34 | 3 | 20 | A | A | 4.9 | Small | A |
| 9-35 | 3 | 42 | B | C | 4.5 | Small | C |
| 9-36 | 4 | 20 | A | A | 4.9 | Small | A |
| 9-37 | 4 | 43 | B | C | 4.4 | Small | C |
| 9-38 | 5 | 20 | A | A | 4.9 | Small | A |
| 9-39 | 5 | 30 | A | A | 4.7 | Small | A |
| 9-40 | 5 | 38 | A | A | 4.4 | Small | A |

(Summary of Test Examples 6 to 9)

The results of Test Examples 6 to 9 reveal that rough rolling under appropriate conditions can produce a magnesium alloy sheet having small variation in grain size of the crystal grains, no problem such as defects in the sheet surface and edge cracks, and excellent plastic workability.

Test Example 10

Magnesium alloy blanks (thickness, 4.0 mm) having a Mg-9.0% Al-1.0% Zn (% by mass) composition and a Mg-9.8% Al-1.0% Zn (% by mass) composition were prepared by twin-roll continuous casting. The centerline segregation produced in the magnesium alloy blanks had a maximum length of 50 μm in the thickness direction of the blanks.

The magnesium alloy blanks were treated under the three types of conditions given below and then rolled.

Mg-9.0% Al-1.0% Zn composition (% by mass)

10-1 . . . Without solution treatment 10-2 . . . 405° C. for 1 hour (solution treatment)

10-3 . . . 405° C. for 10 hours (solution treatment)

Mg-9.8% Al-1.0% Zn composition (% by mass)

10-4 . . . Without solution treatment 10-5 . . . 405° C. for 1 hour (solution treatment)

10-6 . . . 405° C. for 10 hours (solution treatment)

Each of the magnesium alloy sheets prepared by the above-described treatments was rolled to a thickness of 0.6 mm under the following conditions and then heat-treated under appropriate conditions to form a sheet having an average crystal grain size of 5.0 μm.

<Rough rolling: 4.0 mm to 1.0 mm>

Roll surface temperature: 200° C.

Sheet heating temperature: 330° C. to 360° C.

Rolling reduction per pass: 20% to 25%

<Finish rolling: 1.0 mm to 0.6 mm>

Roll surface temperature: 180° C.

Sheet heating temperature: 230° C.

Rolling reduction per pass: 10% to 15%

<Heat Treatment>

Annealing at 320° C. for 30 minutes

Next, a JIS 13B tensile test sample was prepared from each of the sheets and subjected to a tensile test at a strain rate of $1.4\times10^{-3}$ ($s^{-1}$) at room temperature. Also, the alloy structure of a section of each sheet of 0.6 mm in thickness was observed to measure the amount (maximum length in the thickness direction) of centerline segregation. The test methods and meanings were as follows:

Tensile strength=load at breakage/(thickness of specimen×width of sheet)

Yield strength=measured at a proof strength of 0.2%

Yield ratio=yield strength/tensile strength

Elongation at breakage=(gage length when broken ends were placed back together−50 mm)/50 mm*1

*1: A so-called butt method for determining an elongation at breakage from a distance (50 mm) between the two gage marks previously set before the test and a distance between the two gage marks when the broken ends of a sample broken in the test were placed back together.

The results are shown in Table XIV.

TABLE XIV

| No. | Centerline segregation (μm) | Tensile strength (MPa) | Yield strength (MPa) | Elongation at breakage (%) | Yield ratio (%) |
|---|---|---|---|---|---|
| 10-1 | 30 | 340 | 248 | 13 | 72.9 |
| 10-2 | 18 | 365 | 280 | 17 | 76.5 |
| 10-3 | 10 | 380 | 300 | 20 | 79.0 |
| 10-4 | 35 | 348 | 255 | 12 | 73.2 |
| 10-5 | 19 | 370 | 284 | 16 | 76.8 |
| 10-6 | 12 | 386 | 305 | 20 | 79.0 |

It could be confirmed from Table XIV that solution treatment of the magnesium alloy blank prepared by the twin-roll continuous casting method decreases the length of centerline segregation in the thickness direction, thereby producing a magnesium alloy sheet having excellent mechanical properties. In particular, by using a magnesium alloy having a high Al content, including a magnesium alloy corresponding to AZ91, a magnesium alloy sheet having more excellent mechanical properties can be produced by solution treatment for a long time.

Test Example 11

Magnesium alloy blanks (thickness, 4.0 mm) having a Mg-9.0% Al-1.0% Zn composition (% by mass) and a Mg-9.8% Al-1.0% Zn composition (% by mass) corresponding to AZ91 were prepared by twin-roll continuous casting. Each of these blanks was subjected to solution treatment at 405° C. for 10 hours and then rolled to a thickness of 0.6 mm under the conditions given below to prepare a magnesium alloy sheet. The centerline segregation produced in the resultant magnesium alloy sheets had a maximum length of 20 μm in the thickness thereof.

<Rough rolling: 4.0 mm to 1.0 mm>

Roll surface temperature: 200° C.

Sheet heating temperature: 330° C. to 360° C.

Rolling reduction per pass: 20% to 25%

<Finish rolling: 1.0 mm to 0.6 mm>

Roll surface temperature: 180° C.

Sheet heating temperature: 230° C.

Rolling reduction per pass: 10% to 15%

Next, each of the magnesium alloy sheets prepared by rolling under the above-described conditions was treated under the three types of conditions given below to form a sheet for evaluation.

<Heat Treatment>

(1) Without heat treatment after rolling (2) Annealing at 230° C. for 1 minute (3) Annealing at 320° C. for 30 minutes Next, a JIS 13B tensile test sample was prepared from each of the sheets and subjected to a tensile test at a strain rate of $1.4\times10^{-3}$ ($s^{-1}$) at four temperatures (room temperature, 150° C., 200° C., and 250° C.). Also, the alloy structure of a section of each sheet of 0.6 mm in thickness was observed before and after the tensile test. The test methods and the meanings of terms were the same as in Test Example 10, and the description thereof is omitted.

The results are shown in Tables XV and XVI. Table XV shows the results of the test using the magnesium alloy sheets having the Mg-9.0% Al-1.0% Zn composition, and Table XVI shows the results of the test using the magnesium alloy sheets having the Mg-9.8% Al-1.0% Zn composition.

TABLE XV

| No. | Heat treatment after rolling | Metal structure | Test temperature | Tensile strength (MPa) | Yield strength (MPa) | Elongation at breakage (%) |
|---|---|---|---|---|---|---|
| 11-1 | No | Residual work strain | 25° C. | 420 | 360 | 1 to 3 |
| 11-2 | No | Residual work strain | 150° C. | 190 | 140 | 30 to 90 |
| 11-3 | No | Residual work strain | 200° C. | 95 | 65 | 60 to 210 |
| 11-4 | No | Residual work strain | 250° C. | 52 | 33 | 65 to 220 |
| 11-5 | 230° C. 1 min | Partially recrystallized | 25° C. | 400 | 340 | 2 to 3 |
| 11-6 | 230° C. 1 min | Partially recrystallized | 150° C. | 200 | 158 | 40 to 60 |
| 11-7 | 230° C. 1 min | Partially recrystallized | 200° C. | 100 | 73 | 40 to 205 |
| 11-8 | 230° C. 1 min | Partially recrystallized | 250° C. | 60 | 40 | 80 to 190 |
| 11-9 | 320° C. 30 min | Completely recrystallized | 25° C. | 365 | 280 | 16 to 18 |
| 11-10 | 320° C. 30 min | Completely recrystallized | 150° C. | 220 | 170 | 50 to 60 |
| 11-11 | 320° C. 30 min | Completely recrystallized | 200° C. | 140 | 130 | 80 to 86 |
| 11-12 | 320° C. 30 min | Completely recrystallized | 250° C. | 90 | 80 | 100 to 110 |

TABLE XVI

| No. | Heat treatment after rolling | Metal structure | Test temperature | Tensile strength (MPa) | Yield strength (MPa) | Elongation at breakage (%) |
|---|---|---|---|---|---|---|
| 11-13 | No | Residual work strain | 25° C. | 428 | 368 | 1 to 2 |
| 11-14 | No | Residual work strain | 150° C. | 195 | 145 | 34 to 88 |
| 11-15 | No | Residual work strain | 200° C. | 100 | 70 | 65 to 200 |
| 11-16 | No | Residual work strain | 250° C. | 56 | 35 | 67 to 210 |
| 11-17 | 230° C. 1 min | Partially recrystallized | 25° C. | 410 | 345 | 2 to 4 |
| 11-18 | 230° C. 1 min | Partially recrystallized | 150° C. | 210 | 165 | 40 to 65 |
| 11-19 | 230° C. 1 min | Partially recrystallized | 200° C. | 108 | 77 | 50 to 195 |
| 11-20 | 230° C. 1 min | Partially recrystallized | 250° C. | 65 | 45 | 75 to 203 |
| 11-21 | 320° C. 30 min | Completely recrystallized | 25° C. | 368 | 285 | 16 to 19 |
| 11-22 | 320° C. 30 min | Completely recrystallized | 150° C. | 226 | 175 | 55 to 65 |
| 11-23 | 320° C. 30 min | Completely recrystallized | 200° C. | 145 | 129 | 84 to 90 |
| 11-24 | 320° C. 30 min | Completely recrystallized | 250° C. | 92 | 80 | 105 to 114 |

<Structure of Magnesium Alloy Sheet Before Pressing>

Tables XV and XVI indicate that the sheets (11-9 to 11-12 or 11-21 to 11-24) annealed at 320° C. for 30 minutes have no strain accumulated in the magnesium alloy sheets by rolling work and are completely recrystallized. On the other hand, in the sheets (11-5 to 11-8 or 11-17 to 11-20) annealed at 230° C. for 1 minute, the residual strain of the crystal grains produced by rolling work partially remains. In addition, in the sheets (11-1 to 11-4 or 11-13 to 11-16) not heat-treated, the residual strain of the crystal grains produced by rolling work remains.

<Structure of Magnesium Alloy Sheet After Plastic Deformation>

In the sheets completely recrystallized by annealing at 320° C. for 30 minutes, the crystal grains in the structures of the sheets were not coarsened by heating (250° C. or less) in tensile work, thereby causing substantially no change in the average crystal grain size before and after the work. Therefore, it is supposed that in each of the sheets, a portion deformed by the tensile work is improved in hardness and strength by the accumulated work strain, and a portion not deformed is not changed in hardness and strength. On the other hand, in the sheets (not annealed or annealed at 230° C. for 1 minute) having the residual work strain produced by rolling, the metal structures were recrystallized by heating in tensile work to decrease strength and hardness. Furthermore, after the work, a portion not deformed is decreased in strength, and a portion deformed is decreased or improved in strength according to the degree of heating in the work. Therefore, if a magnesium alloy sheet contains a portion decreased in strength and hardness after working, it is impossible to stably produce a magnesium alloy product having desired mechanical properties.

<High-Temperature Tensile Properties>

The sheets annealed at 320° C. for 30 minutes showed high tensile strength, yield strength, and elongation at breakage at room temperature and also showed high elongation at breakage at 200° C. and 250° C. On the other hand, the sheets having residual work strain showed abnormally high elongation at breakage at 200° C. and 250° C. (superplastic phenomenon). However, there were very few sheets exhibiting such a superplastic phenomenon, and the other sheets had low elongation at breakage and caused damage such cracks and flaws during plastic working. Therefore, if there is large variation in elongation at breakage of sheets, the products produced by plastic working of magnesium alloy sheets have unstable quality.

These results reveal that a sheet having residual work strain is changed in metal structure by heating and deformation in plastic working at high temperatures, and stable workability cannot be expected because the degree of the change is unstable. On the other hand, a sheet having a completely recrystallized metal structure is slightly changed in metal structure after working, thereby stabilizing plastic workability and improving the mechanical properties of a portion deformed by the working. Furthermore, it is supposed that a portion not deformed also maintains the mechanical properties before working. Therefore, a sheet in which the work strain accumulated in rolling work has been relieved has stable mechanical properties even in high deformation such as press forming and is thus suitable for producing casing products by press forming or the like.

Test Example 12

Next, casting, rough rolling, and finish rolling were carried out under the conditions described in Test Example 11 to prepare magnesium alloy sheets of 0.6 mm in thickness (Mg-9.0% Al-1.0% Zn and Mg-9.8% Al-1.0% Zn). After the finish rolling, each of the magnesium alloy sheets was annealed at 320° C. for 30 minutes to prepare an evaluation sample used in a bending test. The bending test was a so-called three-point bending test in which each sample was supported at two points, and bending pressure was applied to the sample by a forming tool (punch) from the side opposite the support points. The conditions of the bending test are shown below.

<Test Conditions>

Sample dimensions . . . width 20 mm, length 120 mm, thickness 0.6 mm

Test temperature . . . 25° C. (room temperature), 200° C., 250° C.

Tip angle of punch . . . 30°

Radius of punch (=bending radius of sample) . . . 0.5 mm, 1.0 mm, 2.0 mm

Support point distance . . . 30 mm

Penetration depth of punch . . . 40 mm

Penetration rate of punch . . . 1.0 m/min, 5.0 m/min

The test under the above-described conditions was performed to examine the surface state and the amount of spring back of a bending-radius portion of a sample. Also, the overall evaluation of a sample was performed on the basis of the surface state and the amount of spring back. The term "spring back" means the phenomenon that the deformation of a sheet sample produced by a load applied from the punch remains after the load applied from the punch is removed. Namely, when the amount of spring back is large, deformability is decided as "poor", while when the amount of spring back is small, deformability is decided as "good". Therefore, the ease of working of a sample can be decided by examining the amount of spring back. The criteria for the surface state and the amount of spring back are as follows:

<Criteria for Surface State>

No occurrence of cracks . . . A

Occurrence of fine cracks without breakage . . . B

Occurrence of breakage . . . C

<Criteria for Spring Back>

The spring back was evaluated by (angle formed by planes holding bending-radius portion of sample with load applied from punch)−(angle formed by planes holding bending-radius portion without load applied) on the basis of the following criteria:

Difference of 45° or more . . . large spring back

Difference of 100 to less than 45° . . . medium spring back

Difference of less than 10° . . . small spring back

<Overall Evaluation>

Surface state "C" . . . overall evaluation "C"

Surface state "A" and small spring back . . . overall evaluation "A"

Other cases . . . overall evaluation "B"

Furthermore, a bending characteristic value was defined as an index indicating the degree of working. The bending characteristic value is represented by (bending radius (mm) of sample)/(thickness (mm) of sample). As the bending radius of a sample decreases, local pressure is applied to a bending-radius portion of a sample to easily produce damage such as cracks in the sample. As the thickness of a sample increases, the formability of the sample degrades to easily produce damage such as cracks. Therefore, a smaller bending characteristic value represented by the above expression indicates high deformation under severe working conditions.

The results of the evaluation of the surface state, spring back, and bending characteristic value, and the overall evaluation are shown in Tables XVII and XVIII. Table XVII shows the results of the test using the magnesium alloy sheets having the Mg-9.0% Al-1.0% Zn composition, and Table XVIII shows the results of the test using the magnesium alloy sheets having the Mg-9.8% Al-1.0% Zn composition.

TABLE XVII

| No. | Test temperature | Bending radius (mm) | Working rate (m/min) | Radius/ thickness | Spring back | Surface state | Decision |
|---|---|---|---|---|---|---|---|
| 12-1 | 25° C. | 0.5 | 1.0 | 0.83 | Large | B | B |
| 12-2 | 25° C. | 0.5 | 5.0 | 0.83 | Large | B | B |
| 12-3 | 25° C. | 1.0 | 1.0 | 1.67 | Large | B | B |
| 12-4 | 25° C. | 1.0 | 5.0 | 1.67 | Large | B | B |
| 12-5 | 25° C. | 2.0 | 1.0 | 3.33 | Large | A | B |
| 12-6 | 25° C. | 2.0 | 5.0 | 3.33 | Large | A | B |

TABLE XVII-continued

| No. | Test temperature | Bending radius (mm) | Working rate (m/min) | Radius/ thickness | Spring back | Surface state | Decision |
|---|---|---|---|---|---|---|---|
| 12-7 | 200° C. | 0.5 | 1.0 | 0.83 | Small | A | A |
| 12-8 | 200° C. | 0.5 | 5.0 | 0.83 | Small | A | A |
| 12-9 | 200° C. | 1.0 | 1.0 | 1.67 | Small | A | A |
| 12-10 | 200° C. | 1.0 | 5.0 | 1.67 | Small | A | A |
| 12-11 | 200° C. | 2.0 | 1.0 | 3.33 | Small | A | A |
| 12-12 | 200° C. | 2.0 | 5.0 | 3.33 | Small | A | A |
| 12-13 | 250° C. | 0.5 | 1.0 | 0.83 | Small | A | A |
| 12-14 | 250° C. | 0.5 | 5.0 | 0.83 | Small | A | A |
| 12-15 | 250° C. | 1.0 | 1.0 | 1.67 | Small | A | A |
| 12-16 | 250° C. | 1.0 | 5.0 | 1.67 | Small | A | A |
| 12-17 | 250° C. | 2.0 | 1.0 | 3.33 | Small | A | A |
| 12-18 | 250° C. | 2.0 | 5.0 | 3.33 | Small | A | A |

TABLE XVIII

| No. | Test temperature | Bending radius (mm) | Working rate (m/min) | Radius/ thickness | Spring back | Surface state | Decision |
|---|---|---|---|---|---|---|---|
| 12-19 | 25° C. | 0.5 | 1.0 | 0.83 | Large | B | B |
| 12-20 | 25° C. | 0.5 | 5.0 | 0.83 | Large | B | B |
| 12-21 | 25° C. | 1.0 | 1.0 | 1.67 | Large | B | B |
| 12-22 | 25° C. | 1.0 | 5.0 | 1.67 | Large | B | B |
| 12-23 | 25° C. | 2.0 | 1.0 | 3.33 | Large | A | B |
| 12-24 | 25° C. | 2.0 | 5.0 | 3.33 | Large | A | B |
| 12-25 | 200° C. | 0.5 | 1.0 | 0.83 | Small | A | A |
| 12-26 | 200° C. | 0.5 | 5.0 | 0.83 | Small | A | A |
| 12-27 | 200° C. | 1.0 | 1.0 | 1.67 | Small | A | A |
| 12-28 | 200° C. | 1.0 | 5.0 | 1.67 | Small | A | A |
| 12-29 | 200° C. | 2.0 | 1.0 | 3.33 | Small | A | A |
| 12-30 | 200° C. | 2.0 | 5.0 | 3.33 | Small | A | A |
| 12-31 | 250° C. | 0.5 | 1.0 | 0.83 | Small | A | A |
| 12-32 | 250° C. | 0.5 | 5.0 | 0.83 | Small | A | A |
| 12-33 | 250° C. | 1.0 | 1.0 | 1.67 | Small | A | A |
| 12-34 | 250° C. | 1.0 | 5.0 | 1.67 | Small | A | A |
| 12-35 | 250° C. | 2.0 | 1.0 | 3.33 | Small | A | A |
| 12-36 | 250° C. | 2.0 | 5.0 | 3.33 | Small | A | A |

Table XVII shows that in the samples of Mg-9.0% Al-1.0% Zn, the surface state was evaluated as "A" only in the bending test with a bending radius of 2.0 mm, i.e., under mild working conditions (bending characteristic value 3.33) (refer to Sample Nos. 12-15 and 12-16). Also, in the bending test at room temperature, spring back was large, and formability was low regardless of the bending radius and working rate (refer to Sample Nos. 12-1 to 12-6). On the other hand, in the bending test at 200° C. or more, spring back was small, and the surface state was good regardless of the bending radius and the working rate (refer to Sample Nos. 12-7 to 12-18).

On the other hand, as seen from Table XVIII, the samples of Mg-9.8% Al-1.0% Zn showed the completely same results as the samples of Mg-9.0% Al-1.0% Zn. Specifically, in the bending test at room temperature, formability was low (refer to Sample Nos. 12-19 to 12-24), while in the bending test at 200° C. or more, formability was high (refer to Sample Nos. 12-25 to 12-36).

Test Example 13

Casting, rough rolling, and finish rolling were carried out under the conditions described in Test Examples 11 and 12 to prepare magnesium alloy sheets of 0.6 mm in thickness (Mg-9.0% Al-1.0% Zn and Mg-9.8% Al-1.0% Zn). Then, each of the magnesium alloy sheets was treated under the two types of conditions below to prepare evaluation samples used in a press test for examining the surface state of each sample after pressing.

<Heat Treatment>

(1) No heat treatment after rolling (2) Annealing at 320° C. for 30 minutes

<Conditions of Press Test>

Each sample was pressed by a servo pressing machine. Pressing was performed by pressing a parallelepiped upper mold against each sample which was placed on a parallelepiped lower mold to cover a recessed portion thereof. The upper mold is a parallelepiped of 60 mm by 90 mm and had the rounded four corners in contact with the sample, each of the corners having a predetermined bending radius. Furthermore, a heater and a thermocouple were buried in each of the upper and lower molds so that the temperature condition of pressing could be controlled to a desired temperature.

<Test Conditions>

Bending radius of upper mold . . . 0.5 mm, 2.0 mm

Test temperature . . . 200° C., 250° C.

Working rate . . . 0.8 m/min, 1.7 m/min, 3.4 m/min, 5.0 m/min

After pressing under the above-described conditions, the surface state of a bending-radius portion of each sample was examined. The results are shown in Tables XIX and XX. Table XIX shows the results of the test using the magnesium alloy sheets having the Mg-9.0% Al-1.0% Zn composition, and Table XX shows the results of the test using the magnesium alloy sheets having the Mg-9.8% Al-1.0% Zn composition. The surface state means the same as in Test Example 12, and the bending characteristic value was determined by (bending radius of upper mold)/(thickness of sample).

TABLE XIX

| No. | Heat treatment after rolling | Test temperature | Bending radius (mm) | Working rate (m/min) | Bending radius/ thickness | Surface state |
|---|---|---|---|---|---|---|
| 13-1 | No | 200° C. | 0.5 | 0.8 | 0.83 | C |
| 13-2 | No | 200° C. | 2.0 | 0.8 | 3.33 | B |
| 13-3 | No | 200° C. | 0.5 | 1.7 | 0.83 | C |
| 13-4 | No | 200° C. | 2.0 | 1.7 | 3.33 | B |
| 13-5 | No | 200° C. | 0.5 | 3.4 | 0.83 | C |
| 13-6 | No | 200° C. | 2.0 | 3.4 | 3.33 | B |
| 13-7 | No | 200° C. | 0.5 | 5.0 | 0.83 | C |
| 13-8 | No | 200° C. | 2.0 | 5.0 | 3.33 | C |
| 13-9 | 320° C., 30 min | 200° C. | 0.5 | 0.8 | 0.83 | A |
| 13-10 | 320° C., 30 min | 200° C. | 2.0 | 0.8 | 3.33 | A |
| 13-11 | 320° C., 30 min | 200° C. | 0.5 | 1.7 | 0.83 | B |
| 13-12 | 320° C., 30 min | 200° C. | 2.0 | 1.7 | 3.33 | A |
| 13-13 | 320° C., 30 min | 200° C. | 0.5 | 3.4 | 0.83 | B |
| 13-14 | 320° C., 30 min | 200° C. | 2.0 | 3.4 | 3.33 | A |
| 13-15 | 320° C., 30 min | 200° C. | 0.5 | 5.0 | 0.83 | C |
| 13-16 | 320° C., 30 min | 200° C. | 2.0 | 5.0 | 3.33 | A |
| 13-17 | No | 250° C. | 0.5 | 0.8 | 0.83 | B |
| 13-18 | No | 250° C. | 2.0 | 0.8 | 3.33 | A |
| 13-19 | No | 250° C. | 0.5 | 1.7 | 0.83 | B |
| 13-20 | No | 250° C. | 2.0 | 1.7 | 3.33 | A |
| 13-21 | No | 250° C. | 0.5 | 3.4 | 0.83 | C |
| 13-22 | No | 250° C. | 2.0 | 3.4 | 3.33 | A |
| 13-23 | No | 250° C. | 0.5 | 5.0 | 0.83 | C |
| 13-24 | No | 250° C. | 2.0 | 5.0 | 3.33 | B |
| 13-25 | 320° C., 30 min | 250° C. | 0.5 | 1.7 | 0.83 | A |
| 13-26 | 320° C., 30 min | 250° C. | 2.0 | 1.7 | 3.33 | A |
| 13-27 | 320° C., 30 min | 250° C. | 0.5 | 3.4 | 0.83 | A |
| 13-28 | 320° C., 30 min | 250° C. | 2.0 | 3.4 | 3.33 | A |
| 13-29 | 320° C., 30 min | 250° C. | 0.5 | 5.0 | 0.83 | A |
| 13-30 | 320° C., 30 min | 250° C. | 2.0 | 5.0 | 3.33 | A |

TABLE XX

| No. | Heat treatment after rolling | Test temperature | Bending radius (mm) | Working rate (m/min) | Bending radius/ thickness | Surface state |
|---|---|---|---|---|---|---|
| 13-31 | No | 200° C. | 0.5 | 0.8 | 0.83 | C |
| 13-32 | No | 200° C. | 2.0 | 0.8 | 3.33 | B |
| 13-33 | No | 200° C. | 0.5 | 1.7 | 0.83 | C |
| 13-34 | No | 200° C. | 2.0 | 1.7 | 3.33 | B |
| 13-35 | No | 200° C. | 0.5 | 3.4 | 0.83 | C |
| 13-36 | No | 200° C. | 2.0 | 3.4 | 3.33 | B |
| 13-37 | No | 200° C. | 0.5 | 5.0 | 0.83 | C |
| 13-38 | No | 200° C. | 2.0 | 5.0 | 3.33 | C |
| 13-39 | 320° C., 30 min | 200° C. | 0.5 | 0.8 | 0.83 | A |
| 13-40 | 320° C., 30 min | 200° C. | 2.0 | 0.8 | 3.33 | A |
| 13-41 | 320° C., 30 min | 200° C. | 0.5 | 1.7 | 0.83 | B |
| 13-42 | 320° C., 30 min | 200° C. | 2.0 | 1.7 | 3.33 | A |
| 13-43 | 320° C., 30 min | 200° C. | 0.5 | 3.4 | 0.83 | B |
| 13-44 | 320° C., 30 min | 200° C. | 2.0 | 3.4 | 3.33 | A |
| 13-45 | 320° C., 30 min | 200° C. | 0.5 | 5.0 | 0.83 | C |
| 13-46 | 320° C., 30 min | 200° C. | 2.0 | 5.0 | 3.33 | A |
| 13-47 | No | 250° C. | 0.5 | 0.8 | 0.83 | B |
| 13-48 | No | 250° C. | 2.0 | 0.8 | 3.33 | A |
| 13-49 | No | 250° C. | 0.5 | 1.7 | 0.83 | B |
| 13-50 | No | 250° C. | 2.0 | 1.7 | 3.33 | A |
| 13-51 | No | 250° C. | 0.5 | 3.4 | 0.83 | C |
| 13-52 | No | 250° C. | 2.0 | 3.4 | 3.33 | A |
| 13-53 | No | 250° C. | 0.5 | 5.0 | 0.83 | C |
| 13-54 | No | 250° C. | 2.0 | 5.0 | 3.33 | B |
| 13-55 | 320° C., 30 min | 250° C. | 0.5 | 1.7 | 0.83 | A |
| 13-56 | 320° C., 30 min | 250° C. | 2.0 | 1.7 | 3.33 | A |
| 13-57 | 320° C., 30 min | 250° C. | 0.5 | 3.4 | 0.83 | A |
| 13-58 | 320° C., 30 min | 250° C. | 2.0 | 3.4 | 3.33 | A |

TABLE XX-continued

| No. | Heat treatment after rolling | Test temperature | Bending radius (mm) | Working rate (m/min) | Bending radius/ thickness | Surface state |
|---|---|---|---|---|---|---|
| 13-59 | 320° C., 30 min | 250° C. | 0.5 | 5.0 | 0.83 | A |
| 13-60 | 320° C., 30 min | 250° C. | 2.0 | 5.0 | 3.33 | A |

Table XIX indicates that among the samples having the Mg-9.0% Al-1.0% Zn composition, the samples not heat-treated after finish rolling produced cracks or flaws in the surfaces during pressing at a sample temperature of 200° C. In particular, cracks were produced in the surfaces in high deformation with a bending characteristic value of 0.83. The same samples also produced cracks or flaws in the surfaces in the press test at 250° C. with high deformation (bending characteristic value of 0.83). On the other hand, the samples annealed at 320° C. for 30 minutes after finish rolling showed a good surface state in pressing at a sample temperature of 200° C. and a high working rate (refer to Sample Nos. 13-9 and 13-10) and in pressing with a bending characteristic value of 3.33 (refer to Sample Nos. 13-10, 13-12, 13-14, and 13-16). These annealed samples also showed a good surface state in pressing at 250° C. regardless of the bending characteristic value and the working rate.

Table XX indicates that the samples of Mg-9.8% Al-1.0% Zn showed substantially the same test results as the samples of Mg-9.0% Al-1.0% Zn. Namely, the samples annealed at 320° C. for 30 minutes showed a good surface state after pressing as compared with the samples not annealed. Furthermore, the higher the pressing temperature, the better the surface states of the samples. In particular, it was found that in pressing an annealed magnesium alloy sheet at 250° C., press formability is high even in high deformation (characteristic bending value of 0.83) at a working rate of 5.0 m/min.

(Summary of Test Examples 11 to 13)

The results of Test Examples 11 to 13 reveal that when the structure of a magnesium alloy sheet is recrystallized by heat treatment at a proper temperature after rolling, formality is stabilized. The cause of stabilizing formability is supposed to be that the metal structure is not much changed by heating in plastic working (including pressing) because the metal structure is recrystallized before plastic working.

INDUSTRIAL APPLICABILITY

The method for producing the magnesium alloy sheet of the present invention can be suitably used for producing a magnesium alloy sheet having excellent plastic workability, particularly press workability. In addition, the magnesium alloy sheet of the present invention can be suitably used as an alloy material required to have a light weight and high mechanical properties.

The invention claimed is:

1. A method for producing a magnesium alloy sheet, the method comprising:

rolling a magnesium alloy blank with a reduction roll, wherein the rolling includes controlled rolling in which the surface temperature Tb (° C.) of the blank immediately before insertion into the reduction roll satisfies the following expression:

$$8.33\times M+135\leqq Tb\leqq 8.33\times M+165$$

wherein $8.5\leqq M\leqq 10.0$,

M is the Al content (% by mass) in a magnesium alloy constituting the blank, and the surface temperature Tr of the reduction roll is 150° C. to 180° C.

2. The method according to claim 1, wherein the blank is prepared by twin-roll casting.

3. The method according to claim 1, wherein the controlled rolling is performed by a plurality of passes, at least one of the passes being performed in a rolling direction reverse to the rolling direction of the other passes.

4. The method according to claim 1, wherein the average rolling reduction per pass of the controlled rolling is 5% to 20%.

5. The method according to claim 1, wherein rolling of the blank includes rough rolling and finish rolling, and at least the finish rolling is the controlled rolling.

6. The method according to claim 5, wherein in the rough rolling step, the surface temperature Tb of the blank immediately before insertion into the reduction roll used for the rough rolling is 300° C. or more, and the surface temperature Tr of the reduction roll is 180° C. or more.

7. The method according to claim 6, wherein the rolling reduction per pass of the rough rolling is 20% to 40%, and at least two passes of rolling with a rolling reduction in this range are performed.

8. The method according to claim 1, wherein the magnesium alloy blank is subjected to solution treatment at 380° C. to 420° C. for 60 minutes to 600 minutes before rolling.

9. A method for producing a magnesium alloy sheet, the method comprising:

rolling a magnesium alloy blank with a reduction roll, wherein the rolling includes controlled rolling in which the surface temperature Tb (° C.) of the blank immediately before insertion into the reduction roll satisfies the following expression:

$$8.33\times M+135\leqq Tb\leqq 8.33\times M+165$$

wherein $8.5\leqq M\leqq 10.0$.

M is the Al content (% by mass) in a magnesium alloy constituting the blank, and the surface temperature Tr of the reduction roll is 150° C. to 180° C., the magnesium alloy sheet after the finish rolling is heat-treated under the following conditions:

at 300° C. to 340° C. for 10 minutes to 30 minutes for the magnesium alloy having an Al content M of 8.5 to 10.0% by mass and a zinc content of 0.5 to 1.5% by mass, and the total rolling reduction of the controlled rolling is 10% to 75%.

* * * * *